United States Patent [19]

Hickling et al.

[11] Patent Number: 4,495,481

[45] Date of Patent: Jan. 22, 1985

[54] THERMOSTAT WITH BIMETAL COMPENSATING ELEMENT

[75] Inventors: Colin D. Hickling, Frankfort; Marvin Barnes, Stamping Ground, both of Ky.

[73] Assignee: Trigometer, Inc., Frankfort, Ky.

[21] Appl. No.: 393,810

[22] Filed: Jun. 30, 1982

[51] Int. Cl.[3] ..... H01H 37/12; H01H 37/52

[52] U.S. Cl. ..... 337/349; 337/94; 337/95; 337/378

[58] Field of Search ..... 337/86, 92, 94, 95, 337/99, 101, 349, 364, 369, 370, 371, 378, 379, 361

[56] References Cited

U.S. PATENT DOCUMENTS

| | | | |
|---|---|---|---|
| 2,071,209 | 2/1937 | Kuhn et al. | 337/361 |
| 2,399,423 | 4/1946 | Bletz . | |
| 2,623,137 | 12/1952 | Vogelsberg . | |
| 2,716,175 | 8/1955 | Franklin | 337/349 |
| 2,742,547 | 4/1956 | Chang-Kaing Tsai . | |
| 2,769,060 | 10/1956 | Franklin | 337/370 |
| 2,769,890 | 11/1956 | Hallerberg et al. . | |
| 2,786,171 | 3/1957 | Clark . | |
| 2,817,741 | 12/1957 | Turner . | |
| 3,023,287 | 2/1962 | Epstein . | |
| 3,174,014 | 3/1965 | Valverde . | |
| 3,342,961 | 9/1967 | Deaton et al. . | |
| 3,593,253 | 7/1971 | Taylor . | |
| 3,643,197 | 2/1972 | Brosseau . | |
| 3,801,944 | 4/1974 | Brown . | |
| 4,283,701 | 8/1981 | Ryckmann, Jr. . | |

*Primary Examiner*—Harold Broome

*Attorney, Agent, or Firm*—King, Liles and Schickli

[57] ABSTRACT

An electric switch that is temperature responsive is provided for operation in a temperature range that is substantially above normal ambient temperature. A pair of contacts are mounted on respective first and second spring members. The second spring member includes a bimetal compensating portion at the distal end thereof. The second contact is mounted on the compensating portion so that upon increasing the temperature of the switch structure, the second contact moves toward engagement with the first contact to eliminate initial overshoot and to compensate for variable contact weld size between the contacts. An operating bimetal assembly in direct contact with the heated surface being monitored is used to break the contacts. The bimetal assembly includes a bimetal base element and a metal element butt-welded to the distal end thereof. The metal element carries a ceramic button to engage the first or upper spring member to move the first contact. An adjusting rod engages a dimple on the second spring member adjacent the point where the bimetal compensating portion is butt-welded to the spring member. The operating bimetal assembly and the two spring members are mounted and separated by an insulator stack. In an alternative embodiment, the bimetal compensating portion is mounted on the end of a full length second spring member. The compensating portion extends back along the second spring member and directly engages an adjustment rod. As the temperature of the bimetal compensating portion is increased, the second contact moves toward engagement with the first contact in the same manner.

12 Claims, 7 Drawing Figures

THERMOSTAT WITH BIMETAL COMPENSATING ELEMENT

TECHNICAL FIELD

The present invention relates to thermostatic switches, and more particularly, to a high temperature switch including contacts mounted on spring members with automatic compensation for initial overshoot and contact weld size.

BACKGROUND ART

Thermostatic switches for high temperature operation are well known in the art. These switches are used in various applications, one of the most notable of which is for appliances, such as irons. In an iron, the thermostatic switch is responsive to the heat of the soleplate, upon which it is mounted. The switch cycles on and off to maintain the temperature of the iron within the desired set range.

The switch structure includes spring members to support the respective contacts. A means is provided for engaging one of the spring elements as the temperature of the switch rises to break the contacts and interrupt the current to the electric heating element, such as the element in the soleplate of the iron.

Several attempts have been made in the past to improve the operating characteristics of this type of switch. For example, there have been switches designed for a broader effective adjustment range, such as shown in the Tsai U.S. Pat. No. 2,742,547, issued Apr. 17, 1956. This particular patent utilizes a bimetal assembly for engaging one of the spring elements to open the contacts. Because of the different operating characteristics of the two bimetal elements of the bimetal assembly, the broader range of operation is accomplished.

Other thermostatic switches of this type have attempted to alleviate the problem of temperature overshoot that tends to occur on the initial operating cycles. For example, the U.S. Pat. No. 4,283,701, to Ryckman, issued Aug. 11, 1981, includes a structure for a bimetal assembly to open the contacts sooner than otherwise on the initial cycles to prevent the overshoot. In this particular device, again two bimetal portions are required, one of which is bent back on itself and separated by a temperature isolating slot. While these structures using dual bimetal portions on the bimetal assembly for engaging one of the springs and breaking the contacts have worked to a limited degree, they are generally more expensive and also leave much to be desired in terms of consistency of operation. Furthermore, neither patent addresses the problem of improving the consistency of operation and thus maintaining a more constant temperature by compensating for the size of the weld area between the contacts on each operating cycle. Thus, a need is established for a new, relatively low-cost thermostatic switch providing a structure responsive to the above shortcomings of the prior art.

DISCLOSURE OF THE INVENTION

Accordingly, it is a primary object of the present invention to provide a temperature responsive switch including compensating means for prevention of initial overshoot in the cycling of the switch and thus maintain a constant temperature during all operating cycles.

It is still another object of the present invention to provide a thermostatic switch of the type described utilizing simplified bimetallic structures for providing compensation for variation in contact weld size between the contacts and thus provide more consistant operation.

Still another object of the present invention is to provide a thermostatic switch structure providing in one simple change utilizing a bimetallic portion to support one of the contacts to eliminate initial temperature overshoot and to simultaneously compensate for weld size between the contacts.

Still another object of the present invention is to provide a bimetal compensating portion on one of the spring members to support the corresponding contact to compensate for overshoot and weld size.

Additional objects, advantages and other novel features of the invention will be set forth in part in the description that follows and in part will become apparent to those skilled in the art upon examination of the following description or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved thermostatic switch is provided for consistent operation in a temperature range substantially above normal ambient temperature, with the consistent operation being effective during all operating cycles. More specifically, the switch includes first and second contacts mounted on first and second spring members, respectively. The contacts are mounted for cooperation with each other to complete the electric path of the switch. The second spring member includes a bimetal compensating portion. A means is provided for engaging one of the spring members to break the contacts to open the switch. In accordance with the invention, the bimetal compensating portion of the second spring member is adapted to move the second contact toward engagement with the first contact in response to increasing temperature. This results in virtual elimination of overshoot of temperature on the initial cycles of operation and at the same time provides compensation for variable contact weld size that occurs between the contacts.

Preferably, the bimetal portion is butt-welded to the distal end of the second spring element. The contact is mounted on the bimetal portion. This is advantageous since the resistance heating of the contacts by the current flowing through the electrical path of the switch is directly transferred to the bimetal portion to allow compensation for the weld size.

An adjustment rod is provided for varying the position of the second spring element to provide a different temperature setting. The rod is an insulator and engages the second spring element on a dimple spaced from the bimetal portion. Since the bimetal portion is not engaged by the adjustment rod in this particular preferred embodiment, the bimetal portion is free to move solely in response to the temperature being sensed.

The means for engaging the spring element to open the contacts includes an operating bimetal assembly including an insulator button. The bimetal base element of the assembly, is electrically insulated from the first and second spring members by an insulator stack including a plurality of insulator discs. The insulator button is actually carried on a metal element at the distal end of the bimetal base element. The metal element is preferably butt-welded to the base element. In accordance with the broader aspects of the invention, it will be realized that both the bimetal compensating portion of the second spring element as well as the metal element of the bimetal assembly may be lap-welded in position.

In accordance with the features of an alternative embodiment of the present invention, the bimetal compensating portion of the second spring element may extend back along the spring element. In this instance, the adjusting rod engages the bimetal compensating portion. However, in this instance, the second contact, now actually mounted on the second spring member is still moved toward engagement with the first contact in response to increasing temperature so that initial overshoot and variable contact weld size between the contacts is compensated.

Still other objects of the present invention will become readily apparent to those skilled in the art from the following description wherein there is shown and described the one preferred embodiment and an alternative embodiment of this invention. This is simply by way of illustration of two of the best modes contemplated for carrying out the invention. As will be realized, the invention is capable of still other different embodiments, and its several details are capable of modifications in various, obvious aspects all without departing from the invention. Accordingly, the drawings and description will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to the present preferred embodiments of the invention, the examples of which are illustrated in the accompanying drawings.

BEST MODES OF CARRYING OUT THE INVENTION

Figure 1:
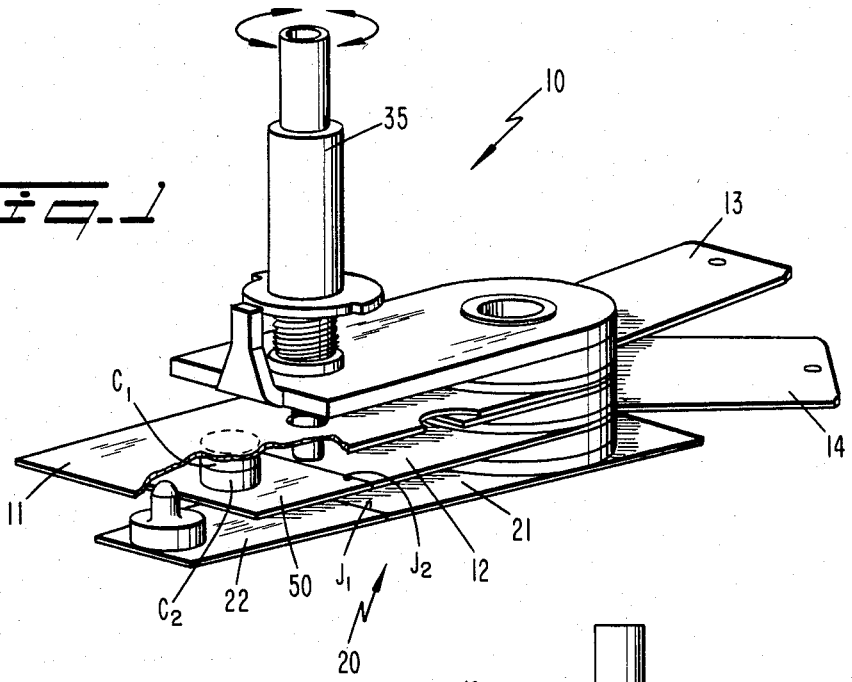
FIG. 1 is a perspective view, with a portion broken away for clarity, showing the thermostatic switch in a preferred embodiment of the present invention.

Reference is now made to FIG. 1 showing an improved thermostatic switch 10 of the present invention. The switch 10 is designed for operation in a temperature range substantially above the normal ambient temperature, such as in an iron, or similar high temperature appliance. As a result of the design of the switch 10, the temperature control during all operating cycles, including the initial cycles, are consistent. The switch is designed for rapid and accurate response to temperature change to provide improved temperature control over the desired range of adjusted temperatures. The main elements of the switch 10 include a first contact $C_1$ mounted on a first spring member 11 and a second contact $C_2$ mounted on a second spring member 12. As will be apparent, the contacts are designed to make and break an electrical circuit for controlling the electric current through the iron or similar appliance. Terminals 13, 14 provide connection to the spring members 11, 12 and contacts $C_1$, $C_2$, respectively. Spade type connectors (not shown) to be received by the terminals 13, 14 are connected in the circuit for the heating element of the iron, and as will be readily understood as the contacts $C_1$, $C_2$ make and break contact, the heating element is cycled on and off to control the termperature.

In order to make and break the contacts $C_1$, $C_2$ as indicated, the switch 10 is provided with a means for engaging the spring 11 to simply lift the contact $C_1$ from engagement with the contact $C_2$. The engaging means of the present invention comprises an operating bimetal assembly, generally designated by the reference numeral 20 (see FIGS. 1 and 2). The bimetal assembly includes a bimetal base element 21 and a metal element 22 butt-welded to the distal end of the bimetal base element. The butt-welded joint is designated as $J_1$ in FIGS. 1 and 2. An insulator button 23 is mounted on the free end of the bimetal assembly 20.

As shown in FIG. 1, the bimetal assembly 20, including bimetal base element 21 and metal element 22, is tapered with the portion of reduced width positioned adjacent the insulator button 23. Advantageously, the tapering allows heat transfer by convection directly from the heating element, such as the underlying sole plate S of an iron, to the second spring member 12. Such direct heat transfer aids in allowing compensation for initial overshoot as discussed below.

The bimetal assembly is directly mounted on sole plate S of the iron, or other similar heated surface to be controlled. The direct mounting of the bimetal base element on the sole plate S provides for rapid heat transfer in order to provide maximum response of the switch 10 to temperature change. A threaded mounting stud 24 passes through an insulator stack, generally designated by the reference numeral 25. The function of the insulator stack is to electrically separate the spring elements 11, 12 and the bimetal assembly 20. Stack 25 includes a rivet 26 and a plurality of ceramic insulator discs 27, 28, 29 (see FIG. 2).

In order to provide adjustment for the desired temperature setting of the iron or other appliance being controlled, a threaded adjustment shaft 35 mounted on a support arm 36 positioned on the top of the insulator stack 25 is provided. As the shaft 35 is turned, as shown by the action arrows in FIG. 1, an adjustment rod 38, fabricated of an insulator material, such as ceramic, is operative to reposition the spring member 12. The ceramic rod 38 actually engages a dimple 39 on the spring member 12 in order to ensure low friction turning of the shaft 35 and accurate movement of the spring member 12. The spring member 12 is tensioned to constantly engage the operative end of the insulator rod 38 and thus follow the adjusted position. Similarly, the tension in the spring member 11 is such as to provide constant engagement between the contacts $C_1$, $C_2$ so that in the standby position electric current will flow through the switch 10. As will be apparent, and discussed in more detail below, when the temperature sensed by the bimetal assembly 20 reaches the appropriate level, the insulator button 23 engages the distal end of the spring member 11, raises the contact $C_1$ from engagement with the contact $C_2$ against the spring force in the spring member 11, thus breaking the circuit and resulting in successful cycling of the heating element being controlled.

Figure 2:
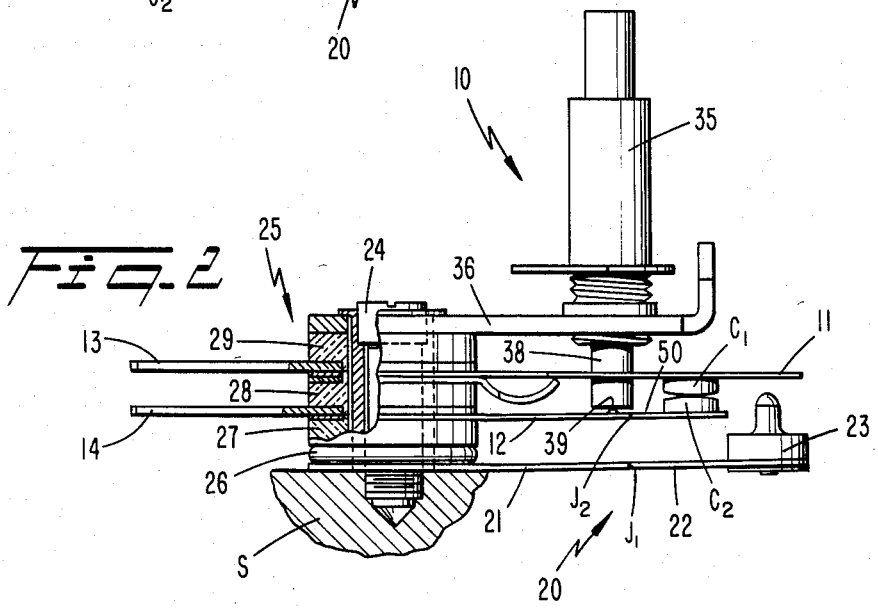
FIG. 2 is a side view, partially in cross-section, showing the switch of the invention mounted on a body for sensing the temperature thereof and with the switch elements in a standby, cool condition.
Figure 3:
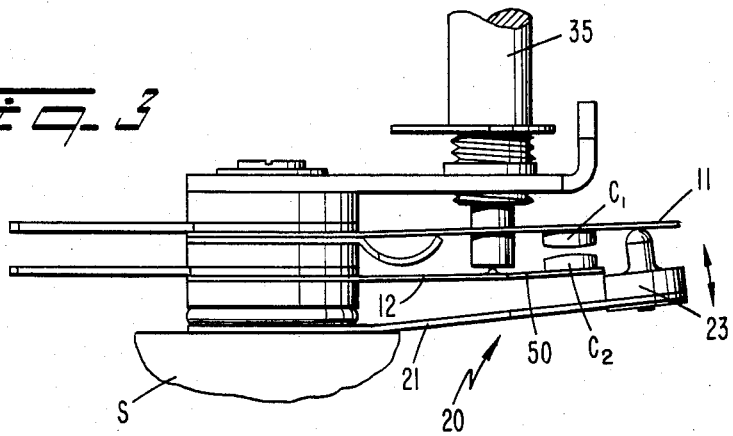
FIG. 3 is a side view of the thermostatic switch showing the switch elements positioned so that the contacts are opened during an initial cycle of operation.

The action of opening the contacts $C_1$, $C_2$ can be seen in FIG. 3. Here, the heat received by the bimetal element 21 causes upward bending and thus engagement of the insulator button 23 with the spring member 11 and opening of the contacts $C_1$, $C_2$. With the heating element of the sole plate S turned off, the bimetal element 21 cools causing a relaxation and return movement to the standby or cool position shown in FIG. 2. Of course, during normal cycling of the heating element, the bimetal assembly 20 will move downwardly (FIG. 3) only so far as required to once again engage the contacts $C_1$, $C_2$. As the heating element continues to cycle, the bimetal assembly 20, 21 moves up and down, as noted by the action arrow in FIG. 3, providing the appropriate relatively constant temperature desired. When a change in temperature is desired, the shaft 35 is simply rotated to move the spring members 11, 12 and contacts $C_1$, $C_2$ together in an up-or-down direction. With the repositioning, this simply means that the bimetal assembly 20 has to move to a higher position (higher temperature) or a lower position (lower temperature) to provide the desired opening and closing of the contacts $C_1$, $C_2$.

In accordance with the present invention as indicated above, the switch 10 is designed to overcome a significant problem of the past: the tendency of thermostatic switches of this type to initially overshoot the set temperature. In other words, in the past, when the iron or other appliance is initially turned on, the tendency has been for the contacts of the switch to open later than required to establish the proper temperature. With the contacts not opening properly, a significant increase in the temperature is possible providing obvious deleterious results. In the case of an iron, the temperature during the initial ironing period can be too high for the fabric being ironed causing damage to the fabric and thus dissatisfaction to the user. Now in contrast, with the problem solved, the user can immediately proceed to iron, rather than waiting an extended period to allow the temperature of the iron to stabilize as has been the practice in some instances in the past, thus saving significant amounts of electricity.

To accomplish the compensating function, the spring member 12 includes a bimetal portion 50 butt-welded at a joint $J_2$ (see FIGS. 1 and 2). In the cool standby position of the iron, shown in FIG. 2, the bimetal portion 50 extends substantially straight from the spring member 12. It will be remembered that the spring members 11, 12 are biased toward each other to maintain the contacts $C_1$, $C_2$ in engagement. The bimetal compensating portion 50 is mounted so as to move the second contact $C_2$ toward engagement with the first contact $C_1$ in response to increasing temperature.

When the iron is first turned on, the sole plate S heats up due to the contacts $C_1$, $C_2$ being in engagement and heat is directly transferred in the desirable manner to the operating bimetal assembly 20. As the bimetal base element 21 is heated by this direct contact, the button insulator 23 is lifted and finally engages the spring element 11 separating the contacts $C_1$, $C_2$ as previously described. The set temperature of the switch 10 is thus established by the operation on this initial cycle. The heat from the sole plate S has been directly transferred by conduction to the bimetal base element 21 and sustained that temperature sufficiently to open the contacts $C_1$, $C_2$. However, on this initial cycle, the ambient temperature of the iron is still relatively cool. This means that the bimetal base element 21 during these initial cycles will lose a significant amount of heat by convection. Thus, after the initial warm-up, it will be clear that the bending action of the base bimetal element 21 will be greater than occurred on the initial cycle, as shown in FIG. 3. It is for this reason that the contact $C_2$ is mounted in accordance with the present invention to move toward engagement with the first contact $C_1$ so that on the subsequent cycles when more heat is present to affect the base element 21, and thus a higher position effective for opening the contacts, the contacts $C_1$, $C_2$ will be at a higher location and thus opened at the same temperature of the sole plate S as desired.

Figure 4:
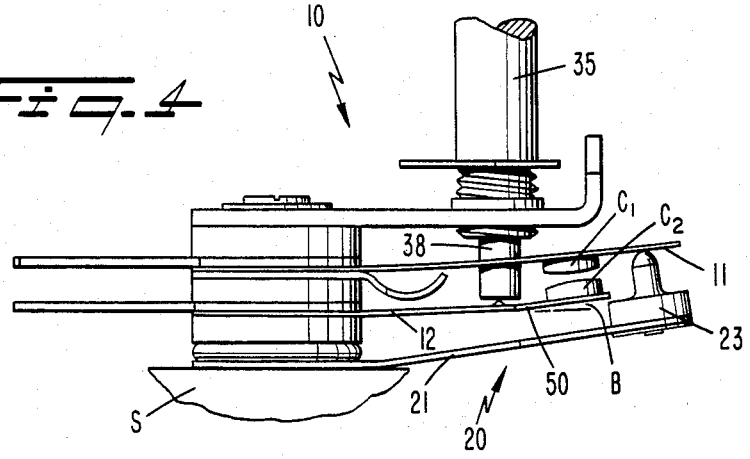
FIG. 4 is another side view of the switch of the invention showing the switch contacts also open and during a later operating cycle.

There is some heat transferred by convection during the initial heating cycle causing the contact $C_2$ to move slightly upwardly toward the contact $C_1$, as shown in FIG. 3. However, as shown in FIG. 4, on the second and subsequent cycles, the bimetal portion 50 has moved substantially higher by bending due to the substantially increased ambient heat. This increased bending and raising of the contact $C_2$ toward engagement with the contact $C_1$ is represented by the angle B (FIG. 4). Thus, as the convection losses of the base bimetal element 21 are reduced to zero and thus the temperature is increased beyond that of the initial cycle (FIG. 3) the stabilized temperature of the bimetal portion 50 increases by a like amount so that on each following cycle, the insulator button 23 is effective to open the contacts $C_1$, $C_2$ at precisely the same temperature as established on the initial cycle. In other words, as the effective temperature of the base bimetal element 21 is increased, the effective temperature of the bimetal portion 50 is also increased through heat transfer by convection from the sole plate S past the reduced width portion of the bimetal assembly 20, thus directly compensating for the change in temperature and maintaining the temperature at the desired setting.

Of course, if a different temperature setting is desired, such as for the purpose of ironing on a different type of fabric, the shaft 35 is rotated, thereby repositioning the spring element 12. Since the insulator rod 38 engages the spring member 12 in a position spaced from the bimetal portion 50, the free movement of the bimetal portion 50 is retained, thus allowing the maintenance of the compensating function. At any temperature setting, the interruption of the electricity on the first cycle (FIG. 3) will be made sooner to more accurately limit the temperature of the sole plate S and prevent the initial overshoot. The structure of having a single bimetal portion 50 attached to the spring element 12 is simpler, lower in cost and more effective than previous attempts to solve the same problem. The base bimetal element 21 and the bimetal portion 50 have in practice proven to be highly accurate in tracking each other's action. This is done without any mutilation of the parts and without expensive mechanical bending fabricating steps of the bimetal portions that also tend to impose inaccuracies in the response. As illustrated, the bimetal base element 21 and the bimetal portion 50 move in concert as the ambient temperature rises and thus the effective temperature increases, providing the desired accurate compensation and maintaining the sole plate S at the desired temperature setting during all operating cycles.

Figure 5:
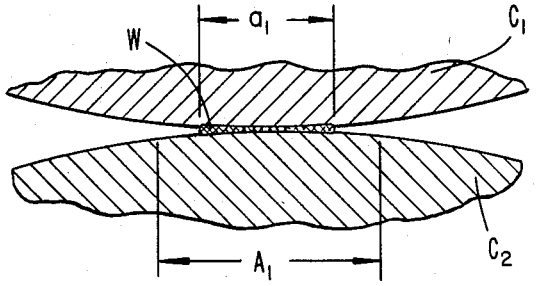
FIG. 5 is an enlarged cross-sectional view of the mating contacts of the switch of the present invention showing different contact weld sizes.
Figure 6:
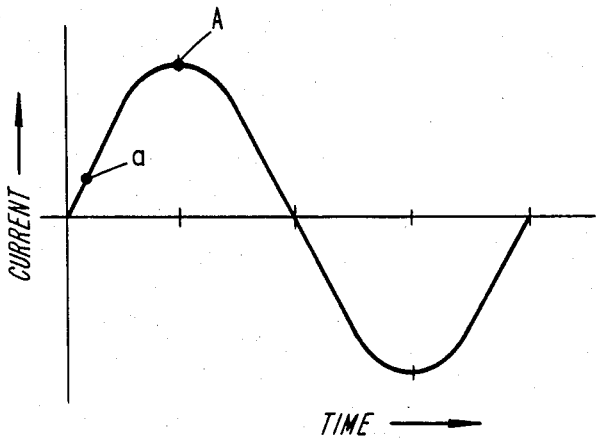
FIG. 6 is a graph showing a conventional sine wave alternating current typical of the electric current being passed through the switch of the invention in operation.

The switch 10 of the present invention also provides another unique compensating function to further maintain the desired consistent operation. As best shown in FIGS. 5 and 6, when the contacts $C_1$, $C_2$ of the switch 10 are in contact transmitting electrical current, an actual weld area W will form at the interface between the contacts $C_1$, $C_2$. If the initial engagement occurs at a low current point a in the alternating current cycle (see FIG. 6), a corresponding relatively small weld area W, denoted by reference indicia $a_1$, is established (see FIG. 5). Conversely, if the engagement of the contacts is made at a point of maximum current in the cycle such as point A (FIG. 6), then a large weld area denoted by area $A_1$ is established.

It is recognized in accordance with the present invention that the force required to separate the contacts $C_1$, $C_2$ when the small area $a_1$ is welded is significantly less than if the large area $A_1$ is welded. Thus, it is found desirable to provide an appropriate differential in the point of engagement of the insulator button 23 depending on the contact weld size. The bimetal compensating portion 50 uniquely incorporates the proper compensating factor thus further assuring consistent switch operation during all operating cycles.

To explain this compensating function, it should be realized that with a small weld area $a_1$, there is greater resistance to the current flowing through the spring members 11, 12 and thus more electric heating of these elements and including the bimetal portion 50. As more heating occurs, the temperature of the bimetal portion 50 rises and the contact $C_2$ is moved in response to this temperature toward the contact $C_1$. This in effect slightly increases the angle B (FIG. 4). As a consequence, the insulator button 23 is effective in finally separating the contacts $C_1$, $C_2$ with minimum force and thus bending of the spring member 11. On the other hand, when the larger weld area $A_1$ is made to occur, there is less electric resistance heating of the bimetal portion 50 resulting in less upward bending, and engagement of the button 23 with the spring member 11 occurs at an earlier point in the cycle. Greater force can then be exerted as the button 23 moves upwardly to effectively break the weld.

To explain this phenomena another way, to break the small weld area $a_1$, engagement of the spring member 11 should occur slightly later; and to break the large weld area $A_1$, the engagement of the spring element 11 should occur slightly earlier. With this compensation, the factor of error previously built in due to varying force requirements is automatically compensated. Accordingly, greater accuracy of temperature and more consistent operation is attained.

It should be noted in previous designs for overshoot compensation that there is no provision for compensation for variation in weld area. A significant contribution of the present invention is the concept of correction of both problems, that is, initial overshoot and variable contact weld size, with a single simplified structure. The end result is greatly improved accuracy of the switch 10 in response to temperature changes.

Figure 7:
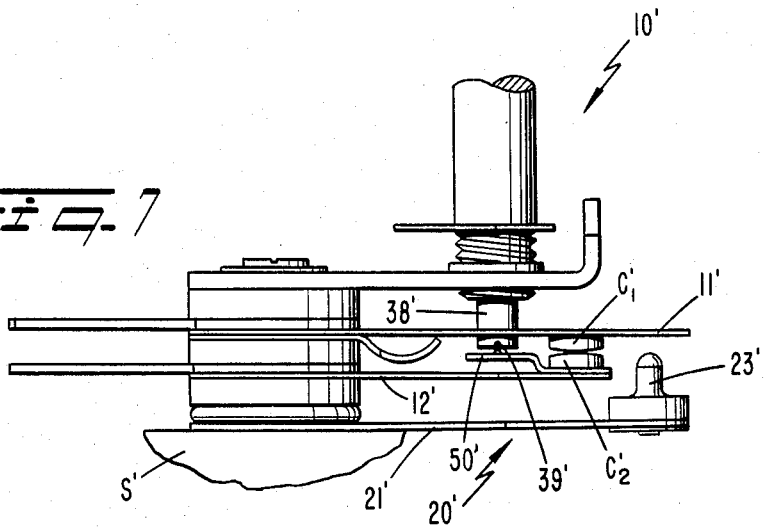
FIG. 7 is a cross-sectional view of an alternative embodiment of a thermostatic switch of the present invention in the standby, cool operating mode.

An alternative embodiment shown in FIG. 7 includes the same essential parts and these parts have been labeled with the same reference indicia with the addition of a prime. Thus, thermostatic switch 10' includes an operating bimetal assembly 20' for opening contacts $C_1'$ and $C_2'$. The button 23' engages spring member 11' to accomplish this function.

In this embodiment, the insulator rod 38' engages a bimetal portion 50' supported at the distal end of full length spring member 12'. The bimetal portion 50' is lap-welded on the end of the spring member 12' so as to extend back along the spring element (see FIG. 7). The contact $C_2'$ is welded on top of the lap-welded portion of the bimetal portion 50'. An engaging dimple 39' is formed on the bimetal portion 50'. Thus, in effect, the adjustment rod 38' positions the contacts $C_1'$, $C_2'$ and provides compensation for overshoot and variable contact weld size in a similar manner, as will now be described.

From the initial, cool position of the switch 10' shown in FIG. 7, the heating of the sole plate S' will cause the operating bimetal assembly 20' to raise the insulator button 23', engage the spring member 11' and urge the contacts open. On the initial cycle, there will be little or no bending of the bimetal portion 50' even though there is significant bending action of the bimetal element 21' due to the direct heat transfer relationship with the sole plate S'. The initial interruption point will thus be established at a set temperature. In subsequent operating cycles, as the effective temperature of the bimetal element 21' rises, the effective temperature of the bimetal portion 50' likewise rises thus compensating for this factor. The bimetal portion 50' is designed to bend downwardly toward the spring element 12' thus effectively moving the contact $C_2'$ toward the first contact $C_1'$ in response to the increasing temperature. Furthermore, the electric resistance heating also transmits directly to the bimetal portion 50' providing the compensation for the weld size, substantially as before.

In view of the foregoing, it is evident the results and advantages of the switch 10, 10' of the present invention provide substantial results and advantages over the prior art. The compensating portion 50, 50' of the spring member 12, 12' cause the contact $C_2$, $C_2'$ to move toward engagement with the first contact $C_1$, $C_1'$. As the effective temperature of the bimetal element 21, 21' of the operating bimetal assembly 20, 20' increases, the temperature of the bimetal portion 50, 50' increases by a like amount resulting in the desired temperature consistency in the sole plate S, S' of the iron or other appliance. The switch 10, 10' is constructed to be simple, and yet rugged in use. The operation is maintained consistent during all operating cycles for the lifetime of the appliance.

The foregoing description of the preferred as well as one alternative embodiment of the invention has been presented for purposes of illustration and description. These are not intended to be exhaustive or to limit the invention to the precise forms disclosed. Obvious modifications or variations are possible in light of the above teachings. The embodiments were chosen and described in order to best illustrate the principles of the invention and its practical application to thereby enable one of ordinary skill in the art to best utilize the invention in various embodiments and with various modifications as are suited to the particular appliance or other use contemplated. It is intended that the scope of the invention be defined by the claims appended hereto.

We claim:

1. A temperature responsive switch for consistent operation of a heating element or the like in a temperature range substantially above normal ambient temperature during all operating cycles comprising a first contact mounted on a first spring member;

a second contact mounted on a second spring member for cooperation with said first contact and including a bimetal compensating portion positioned for heat transfer by convection from the heating element; and means for engaging one of said spring elements to break said contacts;

said bimetal compensating portion adapted to move said second contact toward engagement with said first contact in response to increasing temperature so as to compensate for any increase in temperature in said engaging means during cycling, whereby initial overshoot and variable contact weld size between the contacts is compensated and the desired temperature setting is maintained in a narrow range.

2. The temperature responsive switch of claim 1 wherein said bimetal portion is mounted on the free end of said second spring element and said second contact is mounted on said bimetal portion, whereby resistance heating of said contacts is directly transferred to said bimetal portion to allow compensation for the weld size between the contacts.

3. The temperature responsive switch of claim 1 wherein is further provided an adjustment rod for varying the position of said second spring element, said rod being an insulator and engaging said second spring element spaced from said bimetal portion to allow free movement thereof responsive to temperature changes.

4. The temperature responsive switch of claim 3 wherein is provided a dimple on said second spring element adjacent said bimetal portion for engagement with the end of said adjustment rod.

5. The temperature responsive switch of claim 1 wherein said engaging means comprises an operating bimetal assembly including an insulator button on the free end, said button engaging said first spring element to break said contacts.

6. The temperature responsive switch of claim 5 wherein said bimetal assembly includes a bimetal base element, insulator stack means separating said base element, said second spring member and said first spring member.

7. The temperature responsive switch of claim 6 wherein is provided a metal element attached to the free end of said bimetal base element to support said button.

8. The temperature responsive switch of claim 7 wherein said bimetal base element is butt-welded to said metal element.

9. The temperature responsive switch of claim 2 wherein said second spring element is butt-welded to said bimetal portion.

10. The temperature responsive switch of claim 2 wherein said second spring element supports said second contact at its free end, said bimetal compensating portion extending back along said second spring element.

11. The temperature responsive switch of claim 10 wherein is provided adjustment means in engagement with bimetal compensating portion, whereby upon adjustment the temperature setting may be varied.

12. A temperature responsive switch for consistent operation of a heating element or the like in a temperature range substantially above normal ambient temperature during all operating cycles comprising a first contact mounted on a first spring member;

a second contact mounted on a second spring member for cooperation with said first contact and including a bimetal compensating portion; and means for engaging one of said spring elements to break said contacts, said engaging means including a portion of reduced width allowing direct heat transfer by convection from the heating element to said bimetal portion of said second spring member; said bimetal compensating portion adapted to move said second contact toward engagement with said first contact in response to increasing temperature so as to compensate for any increase in temperature in said engaging means during cycling, whereby intitial overshoot and variable contact weld size between the contacts is compensated and the desired temperature setting is maintained in a narrow range.

* * * * *